US005091215A

United States Patent [19]

Tanimoto et al.

[11] Patent Number: 5,091,215

[45] Date of Patent: Feb. 25, 1992

[54] COATING METHOD

[75] Inventors: Yoshio Tanimoto; Tadamitsu Nakahama; Takakazu Yamane, all of Hiroshima, Japan

[73] Assignee: Mazda Motor Corporation, Hiroshima, Japan

[21] Appl. No.: 700,045

[22] Filed: May 7, 1991

Related U.S. Application Data

[63] Continuation of Ser. No. 328,545, Mar. 24, 1989, abandoned.

[30] Foreign Application Priority Data

Mar. 25, 1988 [JP] Japan ..... 63-71334
Mar. 25, 1988 [JP] Japan ..... 63-71333
Mar. 25, 1988 [JP] Japan ..... 63-71338

[51] Int. Cl.[5] ..... B05D 3/12

[52] U.S. Cl. ..... 427/240; 427/346; 427/379; 427/425

[58] Field of Search ..... 427/240, 425, 346, 379

[56] References Cited

U.S. PATENT DOCUMENTS 4,702,968 10/1987 Masuhara et al. ..... 427/409 X
4,731,290 3/1988 Chang ..... 427/409
4,741,932 5/1988 Ichimura et al. ..... 427/409

*Primary Examiner*—Janyce Bell
*Attorney, Agent, or Firm*—Fish & Richardson

[57] ABSTRACT

In the coating method containing a coating step for coating a substrate with a paint and a drying step for drying the paint coated thereon, the paint is sprayed on a side extending in an up-and-downward direction and a side extending a horizontal direction in the coating step in such a manner that it is coated in a given film thickness on the horizontally extending side and in a film thickness on the up-and-downwardly extending side, which is thicker than its sagging limit thickness in which it sags. The coating is effected such that the coating on the up-and-downwardly extending side is finished at the same time as or subsequent to the coating on the horizontally extending side.

In the drying step, the substrate is rotation about its horizontal axis extending in a horizontal and longitudinal direction of the substrate during a period of time from before the paint sags to until it is cured to a sagless state. The rotation of the substrate is carried out at a speed which is high enough to reverse its vertical position to its horizontal position before the paint sags due to gravity yet which is low enough to cause no sagging as a result of centrifugal force.

21 Claims, 14 Drawing Sheets

COATING METHOD

This application is a continuation of U.S. application Ser. No. 07/328,545, filed Mar. 24, 1989, now abandoned.

BACKGROUND OF THE INVENTION

1. Field of the Invention

The present invention relates to a coating method.

2. Description of Related Art

This application has companion cases of U.S. patent application Ser. No. 100,767 now U.S. Pat No. 4,874,639 and Ser. No. 153,669, now abandoned.

Technology relating to the rotation of a coating substrate after coating is disclosed in Japanese Utility Model Publication (kokoku) No. 2,228/1976, Japanese Patent Publication (kokai) Nos. 30,581/1982 and 67,332/1973 as well as U.S. Pat. No. 4,092,953.

Other technology relating to coating a coating substrate is disclosed in Japanese Utility Model Publication (kokai) Nos. 80,930/1983, 109,430/1984, and 21,361/1975, Japanese Utility Model Publication (kokoku) No. 20,053/1981, Japanese Patent Publication (kokai) No. 4,471/1984, as well as U.S. Pat. Nos. 1,948,091, 2,658,008, and 2,598,163.

A coating method for coating an outer surface of a coating substrate such as a vehicle body generally includes a preparation step for preparing for the coating substrate to be coated with a paint by removing dust from the substrate, a coating step for coating the coating substrate with the paint, and a drying step for drying the paint coated thereon. The drying step generally comprises setting and baking steps particularly when a thermosetting paint is used. The setting step is usually carried out prior to the baking step at a temperature which is lower than the ambient temperature during the baking step, for example, at room temperature or at the temperature ranging from 40° C. to 60° C. in order to volatilize a solvent slowly so as to cause no pinholes on the coating surface during the baking step which is usually carried out at approximately 140° C.

The coating substrate is held at a given position on a conveyance means such as a carriage while being conveyed during the preparation, coating, and drying steps.

A degree of flatness or smoothness on the surface of a coating on the coating substrate is one of standards for evaluating a quality of the coat surface. The higher a degree of flatness the smaller a degree of irregularities on a coating surface, thus producing a better coating surface. It is well known that a thicker film thickness of a paint may give a higher degree of flatness on a coating surface. A paint sprayed on the surface of a coating may be said to sag if it is visually observed that the paint coated thereon flows and finds traces on the coating surface by 1 mm to 2 mm until it is cured in the drying step. It may be defined herein that sags of the paint occur if such traces exceed at least 2 mm when visually observed. In other words, a sagging limit thickness of a coating is a film thickness beyond the maximum film thickness in which the coating does not sag and the coating in its sagging limit thickness is caused to sag at least in the drying step if it is left as it is after spraying. On the contrary, a film thickness of the paint within its sagging limit thickness is a film thickness in which it does not sag in the drying step even if it is left as it was sprayed.

Sags of a paint are caused when the paint coated thereon flow downwardly due to gravity. They become more likely to occur if the paint is coated in a film thickness which becomes thicker in one coating.

And it is a matter of course that the sags are caused more likely on a coated surface extending in an up-and-downward direction than on a coated surface extending in a horizontal direction. This enables the paint to be coated on the surface extending horizontally in a film thickness which is thicker than on the surface extending in an up-and-downward direction because the sags or drips of the paint little affect adversely the coating surface extending in a horizontal direction. If the film thickness of a coat on the horizontally extending surface is the same as that on the surface extending in an up-and-downward direction, the former can produce a degree of flatness which is higher than the latter because the paint coated on the horizontally extending surface of a coating surface becomes flattened due to a natural flow in the paint to an extent to which no sags substantially occur.

Conventionally, in order to provide a coat with a higher degree of flatness while preventing sags or drips of a paint coated on the surface of a coating substrate, there have been used paints which are lower in viscosity and less flowable. Even if such thermosetting paints are used, however, a sagging limit of the paint coated on the surface extending in an up-and-downward direction is as high as approximately 40 μm. This sagging limit thickness is the maximum film thickness in which the paint does not substantially sag on the surface of a coating substrate extending in an up-and-downward direction.

Sags or drips of the paint are likely to occur at initial stages of the setting and baking steps, particularly at the initial stage of the baking step so that a film thickness of a coat is determined by a film thickness of the paint coated on the surface of a coating substrate to such an extent that the pain does not sag on an up-and-downwardly extending surface thereof. Accordingly, in order to provide a coat in a film thickness larger than a sagging limit thickness of the paint, the coating step is repeated twice or more in the conventional coating method.

Furthermore, in order to cause no sagging as much as possible in the conventional coating method, for example, using electrostatic deposition technology, the coating step is carried out by spraying a paint from spray guns in such a manner in which it is not sprayed too much. At this end, as shown in FIG. 16, spray guns are generally arranged in a direction in which a carriage D with a vehicle body W as a coating substrate loaded thereon is conveyed (in the direction indicated by the arrow from the left-hand side to the right-hand side in FIG. 11) in such a manner that the spray guns disposed on its inlet side are designed so as to spray a surface of the body W extending in a substantially up-and-downward direction of the body W while the spray guns disposed on its outlet side are designed so as to spray a surface thereof extending in a substantially horizontal direction.

It is effective to rotate a coating substrate about its horizontal axis extending in a substantially horizontal direction of the substrate in order to provide a coating with a higher degree of flatness. In other words, even if the film thicknesses are the same, a coating with a higher degree of flatness may be given by utilizing a flowability of the paint in such a manner that a direction in which gravity acts upon a surface of the coating is artificially changed by rotating the substrate. This technology may produce a similar effect even if the paint is coated in a film thickness which is thicker than a sagging limit thickness of the paint to the contrary of conventional coating techniques.

If, however, this technology would be applied to the conventional coating method in which the coating on an up-and-downwardly extending surface of the substrate is carried out prior to the coating on a horizontally extending surface thereof, sags may be caused on the up-and-downwardly extending surface thereof before the substrate is conveyed to the drying step. And such sags cannot be repaired even if the rotation of the substrate is carried out in the drying step.

SUMMARY OF THE INVENTION

Therefore, the present invention has the object to provide a coating method in which sags of a paint coated on the surface of a coating substrate do not occur as much as possible prior to conveyance to the drying step even if the paint is coated thereon in a film thickness which is thicker than its sagging limit thickness.

Thus the present invention consists of a coating method comprising: a coating step for coating a coating substrate by spraying with a paint, the coating substrate with a first side extending in a substantially up-and-downward direction and with a second side extending in a substantially horizontal direction; and a drying step for drying the paint sprayed thereon; in which the coating step is carried out in a manner that the paint is coated on the second side of the coating substrate in a given film thickness and on the first side thereof in a film thickness which is thicker than a maximum film thickness in which the paint does not sag and the coating on the first side is finished at the same time as or subsequent to the coating on the second side; and the drying step is carried out in a manner that the coating substrate is rotated about its horizontal axis extending in a substantially horizontal and longitudinal direction of the coating substrate at least during a period of time from before the paint sags to until the paint is cured to such an extent to cause no sagging; and the rotation of the coating substrate is carried at a speed which is high enough to reverse a direction of the coating substrate in which gravity acts before the paint substantially sags yet which is low enough to cause no sagging as a result of centrifugal force.

The concept of spraying a coating substrate with a paint contains an electrostatic deposition technology because the spraying of the paint permits a management of a coating in a desired film thickness. On the contrary, the dipping of a coating substrate in a paint is beyond the object of the present invention because the paint is coated generally in a film thickness much larger than 1 mm to 2 mm, when visually observed, which is far beyond a sagging limit thickness of the paint, and because it drips from the surface of the coating as it is drawn up from the paint.

Speeds of rotation of a coating substrate may vary with a film thickness of a paint sprayed thereon and a viscosity of the a paint. The minimum speed of rotation thereof may be defined herein as the minimum value at which the coating on the surface thereof is rotated at least from its vertical position to its horizontal position before the paint coated thereon substantially sags due to gravity. The maximum speed of rotation thereof may be defined herein as the maximum value at which no sagging is caused as a result of centrigal force. Accordingly, the speed at which the rotation of the coating substrate is carried out is set between the minimum value and the maximum value of rotational speeds.

An angle of the axis about which the coating substrate is rotated may be inclined at approximately 30 degrees from the horizontal axis of the substrate extending in a substantially horizontal and longitudinal direction thereof.

The rotation of the coating substrate may be preferably carried out at least in the drying step for a period of time ranging from before the paint substantially sags to until the coating is cured so as to cause no sagging although the substrate may be rotated over a full period of time during the drying step. The rotation of the substrate may be carried out continuously or intermittently in one direction or in alternate directions.

If the drying step comprises sequantial setting and baking steps, the setting step may be carried out at an ambient temperature which is lower than the ambient temperature during the baking step. This serves as slowly volatilizing volatilizable ingredients such as a solvent, thus preventing formation of pinholes on the coating surface during the baking step which is usually carried out at the ambient temperature which is higher than the ambient temperature during the setting step.

In accordance with the present invention, a coating with a higher degree of flatness is given by utilizing a flowability of the paint even if a film thickness of the coating obtained by the coating method is the same as that obtained by the conventional coating method. It is to be noted that a flowability of the paint referred to herein is a degree in which a site where the paint is sprayed on a surface of the coating substrate is in a continuous state in which there is located a portion at which a film thickness of the paint coated thereon is thicker than the surrounding portions at which a film thickness thereof is thinner and the paint at the higher portion flows down toward the surrounding lower portions to flatten irregularities on the coating surface, producing a uniform film thickness. It is thus to be understood that a flowability of the paint cannot be utilized herein if the flowability thereof would be to such an extent that the paint sags or drips from the position where the paint is sprayed in a film thickness as high as 1 mm to 2 mm, when visually observed, which is far larger than its sagging limit thickness.

The coating method according to the present invention permits a provision of a thinner coating with a degree of flatness equal to that of a coating obtainable by the conventional coating method. This saves a quantity of paints which should otherwise be consumed.

In order to cause a paint to sag even in a thin film thickness, it is sufficient to reduce a viscosity of the paint by reducing an amount of a sagging preventive agent used to decrease a degree of flowability of the paint or by increasing an amount of a diluent such as a thinner.

If the paint is sprayed on the surface of a coating substrate extending in an up-and-downward direction thereof subsequent to or at the same time as the spraying on the surface thereof extending in a horizontal direction, the problem with sagging on the up-and-downwardly extending surface thereof prior to conveyance to the drying step can be prevented to a great extent because a time required for conveyance to the drying step from the coating step can be shortened.

Paints to be used for the coating method according to the present invention may be a paint that does not substantially sag during the coating step and causes sagging only during the drying step. Such a paint can remove restrictions which have been placed on the conventional coating method.

More preferred embodiment of the coating method according to the present invention is directed to the coating in a film thickness on the horizontally extending surface of the substrate which is thinner than the coating in a film thickness on the up-and-downwardly extending surface. This embodiment provides a final coating on the up-and-downwardly extending surface with substantially the same degree of flatness as that on the horizontally extending surface.

The other objects and features of the present invention will become apparent in the course of the description of this specification.

DETAILED DESCRIPTION OF THE PREFERRED EMBODIMENTS

Outline of Coating Method

Figure 1:
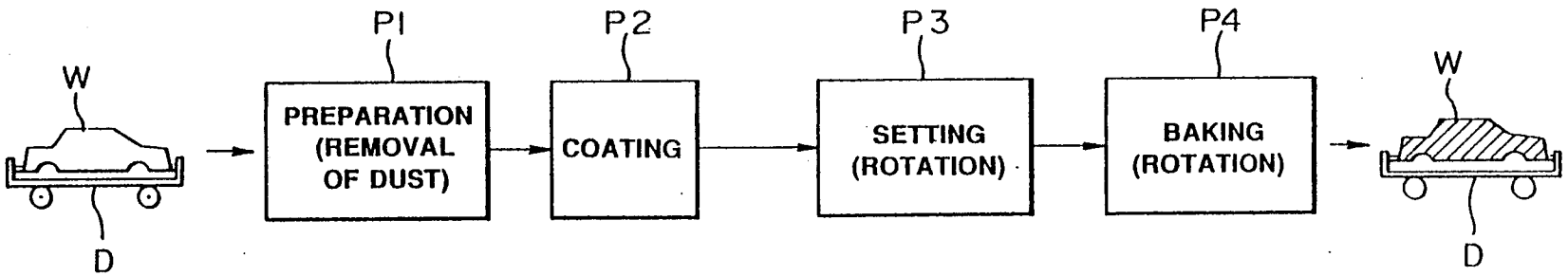
FIG. 1 is a schematic diagram showing an outline of the coating method according to the present invention.

FIG. 1 shows an outline of the whole steps of the coating method according to the present invention, in which a vehicle body W as a coating substrate is coated with a paint. As shown in FIG. 1, the coating method according to the present invention comprises roughly the preparation step P1, the coating step P2, the setting step P3, and the baking step P4. In this specification, the terms "drying step" is intended to mean a sequential combination of the setting step P3 with the baking step P4, unless otherwise stated specifically.

The vehicle body W is first undercoated by conventional methods such as electrodeposition. The vehicle body W undercoated is conveyed on a carriage D to the preparation step P1. In the preparation step P1, dust and other foreign materials are removed from the inside and the outside of the vehicle body W, for example, by vacuum suction or air blowing for subsequent coating procedures. Then the vehicle body W is intercoated in conventional manner in the coating step P2 and the intercoated paint is cured in the setting step P3 and baked in the baking step P4. The body W so intercoated is then overcoated again in the coating step P2. Thereafter, the body W overcoated is cured in the setting step P3 and baked in the baking step P4. The overcoated vehicle body W is then conveyed to an assembly line.

Removal of Dust

In the preparation step P1, dust and other foreign materials are removed from the inside and outside of the vehicle body W by vacuum suction or air blowing. In the preparation step P1, the body W may be preferably rotated about its horizontal axis l, i.e., about an axis extending substantially horizontally in a longitudinal direction of the body W, as will be described in detail in conjunction with FIG. 2.

The rotation of the body W may readily remove dust and other foreign materials from corner portions inside a roof panel, a side sill and other partially closed sections which could not otherwise be removed without rotation of the body W.

Paints

The paints to be used for the coating method according to the present invention may be any paint which has been conventionally used for coating a coating substrate and may include, for example, thermosetting paints, two-component type paints, powder paints and so on. The paints may be conveniently chosen depending upon the kind of coating processes and the outside action to be applied as well as the speed of rotation. As needed, the paints may be used, for example, by adding a sagging preventive agent thereto or by diluting them with a solvent on site.

Particularly, paints to be used for coating the vehicle body W for an automobile may be ones having a number mean molecular weight ranging from about 2,000 to about 20,000 and include a solid coat of conventional type and of high solid type, a metallic base coat of conventional type and of high solid type, and a metallic clear coat of conventional type and of high solid type.

The solid coat of an alkyd melamine resin of conventional type may have a number mean molecular weight ranging from about 4,000 to about 5,000 and of high solid type from about 2,000 to 3,000; the metallic base coat of an acrylic melamine resin of conventional type may have a number mean molecular weight from about 15,000 to about 20,000 and of high solid type from about 2,000 to about 3,000; the metallic clear coat of an acrylic melamine resin of conventional type may have a number mean molecular weight from about 5,000 to about 6,000 and of high solid type from about 2,000 to about 3,000; and the solid coat of a urethane isocyanate resin of conventional type may have a number mean molecular weight from about 7,000 to about 10,000 and of high solid type from about 2,000 to about 3,000. The paints having a number mean molecular weight below about 2,000, on the one hand, are in many cases of the type in which they are cured by electron beams or by ultraviolet rays and they are hard and frail, when cured, leading to the shortening of durability, because their density of cross-linkage is too high. Thus such paints are inappropriate for coating exterior panels of the vehicle body. The paints having a number mean molecular weight above 20,000, on the other, are of the type in which they have a very high viscosity so that they require a large amount of a solvent to dilute. Thus high costs are required to treat the solvent discharged. A latex polymer with a number mean molecular weight over 200,000 is not appropriate because its viscosity is elevated immediately after spraying, thus adversely affecting a degree of flatness on a coating surface.

Coating and Spraying of the Paint

In the coating step P2, the paint may be sprayed on a surface of the vehicle body W as a coating substrate, i.e., a surface thereof extending in a substantially up-and-downward direction and a surface thereof extending in a substantially horizontal direction, in a desired film thickness which is thicker than a sagging limit thickness of a paint to be coated on the surface thereof.

If the conventional thermosetting paint is used, it may be coated on the surface of the body W by spraying on both the up-and-downwardly and horizontally extending surfaces in a film thickness as thick as, for example, 65 μm, which is thicker than its sagging limit thickness of about 40 μm, as have been described hereinabove. The body W is then conveyed to the drying step which usually comprises sequential setting and baking steps P3 and P4, respectively, as shown in FIG. 1.

The paint is coated in the coating step P2 in a film thickness beyond its sagging limit thickness, in which it causes sagging at least in the setting step P3 and, more preferably, in which it causes no sagging before the rotation of the body W is carriied out in the setting step P3 after completion of the coating step P2 yet it sags at least in the setting step P3. The film thickness of the paint to be coated thereon may vary with a viscosity of the paint used, an amount of a sagging preventive agent to be contained therein, and other factors.

The vehicle body W coated with the paint in the coating step P2 is then conveyed on the carriage to the initial stage of the drying step, namely, to the setting step P3, where it is cured to a partial extent at a temperature ranging from 20° C. to 60° C. by slowly volatilizing a volatilizable solvent to form a highly reflective surface coating for the body without pinholes.

The vehicle body W set in the setting step P3 is then conveyed by the carriage to the baking step P4 where it is heated at an ambient temperature during the setting step P3 as high as approximately 140° C.

Rotation of the Coating Substrate

In accordance with the present invention, the rotation of the vehicle body W is carried out about its horizontal axis at least during a period of time from before the paint coated thereon substantially sags to until it is cured to a sagless state, thus drying the coating thereon without sagging even if the paint is sprayed in a film thickness in which it substantially sags. The vehicle body W may be rotated continuously or intermittently in one direction or in alternate directions.

Figure 2:
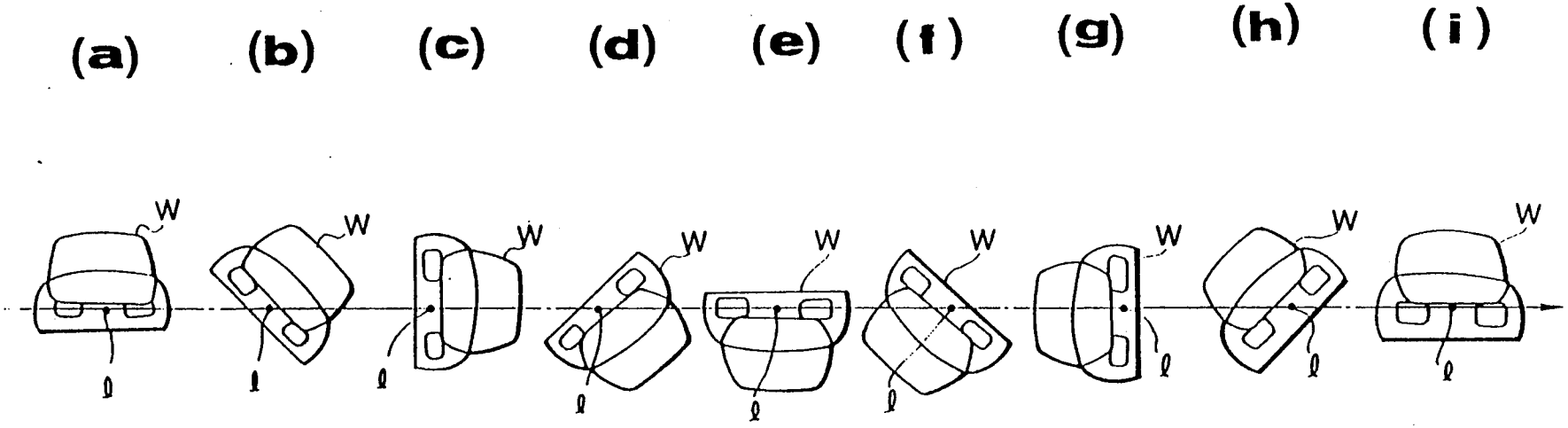
FIG. 2 is a schematic diagram showing a variation of positions of a vehicle body at which it is rotated.

Referring to FIG. 2, FIG. 2(*a*) shows an original position at which the body W is mounted on the carriage. FIG. 2(*b*) shows a position of the body W in which it is rotated at 45 degrees from the original position of FIG. 2(*a*). FIGS. 2(*c*), (*d*), and (*e*) show positions at which it is rotated at 90 degrees, 135 degrees, and 180 degrees, respectively, from the original position thereof. As shown in FIGS. 2(*f*), (*g*), and (*h*), the body W is further rotated at 225 degrees, 270 degrees, and 315 degrees, respectively, from the original position shown in FIG. 2(*a*). FIG. 2(*i*) shows the position at which the body is rotated at 360 degrees from and returned to the original position of FIG. 2(*a*). It should be understood that FIG. 2 is shown merely as references and that the body W may take any position. The rotation of the body W may be carried out on the carriage continuously or intermittently in one direction or in alternate directions in a cycle of rotation in which the body W is turned about its horizontal axis so as to allow every vertically cross-sectional portion of the body W passing through the center of its horizontal axis to pass in equal occasions through the direction of gravity passing through the center thereof. If the body W is rotated in one direction, the rotation may be continuously or intermittently carried out in a clockwise direction in FIG. 2, for example, in a cycle from the original position of FIG. 2(*a*) through FIGS. 2(*b*), (*c*), (*d*), (*e*), (*f*), (*g*), and (*h*) to the original position of FIG. 2(*i*). If it is rotated continuously or intermittently in alternate directions, the rotation may be carried out first in the clockwise direction in FIG. 2, for example, in a first quarter of one cycle from the original position of FIG. 2(*a*) through FIG. 2(*b*) to the position of FIG. 2(*c*) and then reversed back in a counterclockwise direction in a second quarter thereof from FIG. 2(*c*) through FIG. 2(*b*) to the original position of FIG. 2(*a*) and then in a third and quarter thereof from the original position of FIG. 2(*i*), i.e., FIG. 2(*a*), through FIG. 2(*h*) to the position of FIG. 2(*g*). In this case, the rotation of the body W is reversed again in a counterclockwise direction in a fourth quarter of one cycle from the position of FIG. 2(*g*) through FIG. 2(*h*) to the original position of FIG. 2(*i*), namely, FIG. 2(*a*). Furthermore, for example, if the rotation of the body W is reversed at the angle of 135 degrees, the body W is rotated first in a clockwise direction from the original position of FIG. 2(*a*) through FIGS. 2(*b*) and 2(*c*) to FIG. 2(*d*), and the rotation is reversed back in a counter-clockwise direction therefrom through FIGS. 2(*c*) and (*b*) to FIG. 2(*a*). The body W is continued to be rotated therefrom, namely, from FIG. 2(*i*) through FIGS. 2(*h*), (*g*) to FIG. 2(*f*) and then reversed again in a clockwise direction therefrom through FIGS. 2(*g*) and (*h*) to FIG. 2(*i*), namely, to the original position of FIG. 2(*a*). It is to be noted that the rotation of the body W may be reversed at any angle and it is not restricted at any means to those as have been described hereinabove. The angle at which the rotation of the vehicle body W is reversed may be determined on the basis of a direction in which gravity acts on the coating particularly on the up-and-downward direction and of a shape of the vehicle body W, particularly a location of its corner portions, and the like.

As have been described hereinabove, the speed of rotation of the vehicle body W may be determined depending upon a viscosity of the paint and a film thickness thereof coated thereon any may vary within the range between the maximum value and the minimum value, the maximum value being defined as the maximum rotational speed at which the paint coated thereon causes no sagging as a result of centrifugal force and the minimum value being defined as the minimum rotational speed at which the coating surface is rotated from its vertical state to its horizontal state before the paint on the coating surface substantially sags due to gravity. The angle at which the body W is rotated may be inclined at approximately 30 degrees with respect to its horizontal axis. The rotation of the vehicle body W may be carried out for a period of time at least during the drying step ranging from prior to the time when the paint coated thereon substantially sags to the time when the paint causes no sagging. It is noted, however, that the duration of the rotation is not restricted to such a period of time and may last over a full course of time during the drying step, i.e., the sequential setting and baking steps P3 and P4.

Relationship of Film Thickness of Paint with Speed of Paint Sagging

Figure 3:
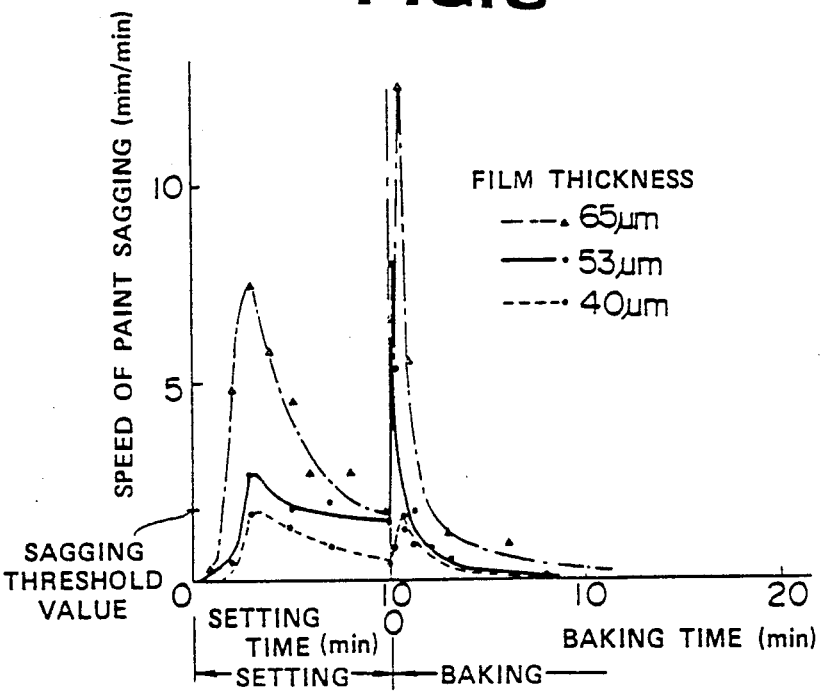
FIG. 3 is a graph showing the relationship of the setting and baking times vs. speeds at which the paint sags.

FIG. 3 demonstrates the influence of film thicknesses of a paint upon the speed at which the paint sags. The speeds of paint sagging are measured for three different film thicknesses of 40 μm, 53 μm, and 65 μm. As shown in FIG. 3, it has been found that a peak of the sagging speed appears at initial stages of the setting and baking steps in each case.

Relationship of Film Thickness with Degree of Flatness

Figure 4:
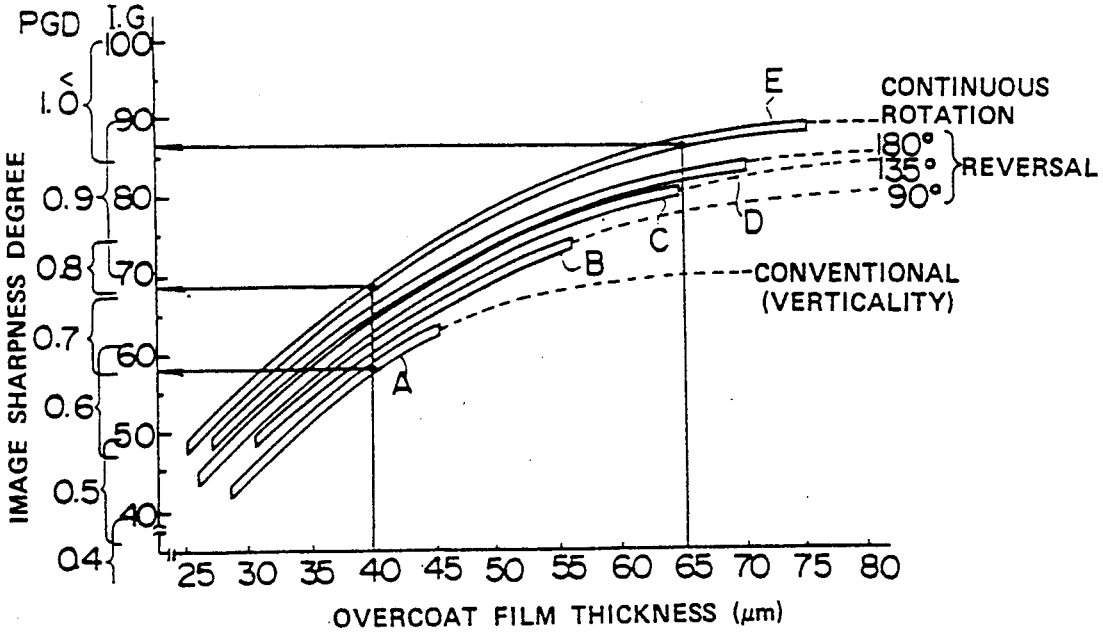
FIG. 4 is a graph showing the relationship of film thicknesses of the paint vs. degrees of image gross.

FIG. 4 shows the influence of the rotation of the vehicle body W about its horizontal axis upon degrees of flatness on the coat surface of the coating substrate expressed in a degree of image gross.

In FIG. 4, reference symbol A denotes a state of the coat surface obtained without the rotation of the vehicle body W in conventional manner. Reference symbol B denotes a state of the coat surface obtained by the rotation of the body W which is carried out in a clockwise direction at the angle of 90 degree, namely, from the position of FIG. 2(*a*) through FIG. 2(*b*) to FIG. 2(*c*) and then reversed in the opposite direction back to the original position of FIG. 2(*a*) from which, namely, from FIG. 2(*i*), the body W in turn is continued to be rotated in the same direction through FIG. 2(*h*) to FIG. 2(*g*) and then turned again in the counterclockwise direction therefrom through FIG. 2(*h*) to the original position of FIG. 2(*i*). Reference symbol C demonstrates a state of the coat obtained when the rotation of the body W is carried out first in a clockwise direction at the angle of 135 degrees, namely, from the original position of FIG. 2(*a*) through FIGS. 2(*b*) and (*c*) to FIG. 2(*d*) and reversed in a counterclockwise direction therefrom through FIGS. 2(*c*), (*b*) to FIG. 2(*a*) from which, namely, from FIG. 2(*i*), rotation is continued to FIG. 2(*h*) and then reversed again in a clockwise direction to the original position of FIG. 2. Reference symbol D demonstrates a state of the surface of the coat which was obtained by the rotation of the body W at the angle of 180 degrees in a clockwise direction from the position of FIGS. 2(*a*) to (*e*) and then by reversal of the rotation in a counterclockwise direction back to the original position of FIG. 2(*a*). In FIG. 4, reference symbol E shows a state of the coat surface obtained when the body W is continuously rotated around in one way from the original position of FIG. 2(*a*) through FIGS. 2(*b*), (*c*), (*d*), (*e*), (*f*), (*g*), and (*h*) to the original position of FIG. 2(*i*), namely, FIG. 2(*a*).

As shown in FIG. 4, it is found that higher degrees of flatness on the coat surfaces are given when the body W is rotated as in the cases of reference symbols B, C, D and E, than reference symbol A, if the film thicknesses are the same. It is also found that a higher degree of flatness can be produced when the body W is rotated continuously in one direction at the angle of 360 degrees than when the rotation is carried out in one direction and then reversed in the opposite direction or directions. It is further found in the result shown in FIG. 4 that the coat obtainable without rotation of the body W is thin in a film thickness, thus leading to a lower degree of flatness and producing a limit upon thickening its film thickness.

When the film thickness of 65 μm was formed on the body W by rotating continuously in one direction at the angle of 360 degrees, a degree of flatness is "87" when expressed in an image gloss (I.G.) as a degree of image, namely, the lowest limit value when the PGD value is 1.0. In the case of the coat in the film thickness of 40 μm formed without rotation, a degree of flatness is "58" when expressed in the image gloss (I.G.), or the lowest limit value when the PGD value is 0.7, while the coat in the film thickness of 40 μm formed by the continuous rotation in one direction at the angle of 360 degrees provides a degree of flatness which is "68" when expressed in the image gloss (I.G.) as a degree of image sharpness, or the lowest limit value when the PGD degree is 0.8. It is understood that the definition for the image gloss (I.G.) in the image sharpness degree is a percentage of an image sharpness on an objective coat surface on the basis of the image gloss of "100" when a mirror surface of a black glass is used, and a PGD value is a value rating identification degrees of reflected images from 1.0. The PGD value gets lower as the degree of flatness gets lower.

The data shown in FIGS. 3 and 4 were obtained by overcoating in the coating step P2 above under following test conditions:

a) Paint: melamine alkid (black)
   Viscosity: 22 seconds/20° C. (measured by Ford Cup #4)
b) Film coater: Minibell (16,000 r.p.m.)
   Shaping air: 2.0 kg./cm$^2$ c)
c) Spraying amounts: sprayed two times
   First time: 100 cc/minute
   Second time: 150–200 cc/minute
d) Setting time/temperature: 10 minutes/room temperature
e) Baking temperature/time: 140° C./25 minutes
f) Degree of flatness on overcoat surface:
   0.6 (PGD) (intercoating on PE tape)
g) Time period for rotation and reversal:
   10 minutes (for the setting step)
   10 minutes (for the baking step)
h) Coating Substrate:

The side surfaces of a square pipe with a 30 cm side are coated and supported rotatably at its center.

i) Rotational speeds:
6, 30, and 60 r.p.m.

It is found that there is no variation in degrees of flatness on the coat surfaces obtained by the different speeds of rotation.

It is to be understood that sags of the paint used hereinabove are caused for the following reasons:

The paint coated in the coating step P2 sags during the setting step P3 because it is still flowable in a wet state on the surface of the substate and it is sprayed in a film thickness which is thicker than the film thickness in which it is conventionally sprayed, whereby gravity acting upon the coating outweighs a viscosity of the paint, thus migrating the paint in a direction of gravity. Sags during the baking step P4 may occur because the paint coated thereon becomes flowable prior to curing by high temperatures during the baking step and migrates in a direction of gravity due to gravity which outweights a viscosity of the paint coated thereon.

Coating Step P2 (FIGS. 16–20)

Figure 18:
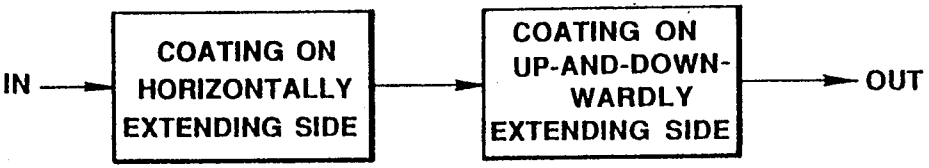
FIGS. 18, 19 and 20 are each a flowchart showing the order of coating sides of a coating substrate.

The coating step P2 is designed herein to coat the vehicle body W as a coating substrate with a paint using plural spray guns which may comprise a spray gun, generally referred to as 50, for spraying the paint on a side of the body W extending in a substantially up-and-downward direction (such a gun will hereinafter be referred to sometimes as "a side spray gun") and a spray gun, generally referred to as 52, for spraying it on a side thereof extending in a substantially horizontal direction (such a gun will hereinafter be referred to sometimes as "a top spray gun"). The side spray gun 50 may comprise a low side spray gun 50*a*, a middle side spray gun 50*b*, and a high side spray gun 50*c*, which are disposed in spaced relationships in a direction in which the body W is conveyed (in a direction indicated by the arrow in FIG. 16) to prevent a reduction in efficiency due to an electrostatic repulsion. The side spray gun 50 and the top spray gun 52 are arranged such that the top spray gun 52 is disposed on the inlet side in a direction in which the body W is conveyed and the side spray gun 50 is disposed on the outlet side in a direction of conveyance of the body W. With this arrangement of the spray guns, the body W is coated by spraying the paint in a sequential order from the top spray gun 52 and the side spray gun 50 which consists the low side spray gun 50*a*, the middle side spray gun 50*b*, and the high side spray gun 50*c* in a row along the direction in which the body W is conveyed. As shown in FIG. 18, the body W is coated by a series of the spray guns and then conveyed to the setting step P3.

Figure 19:
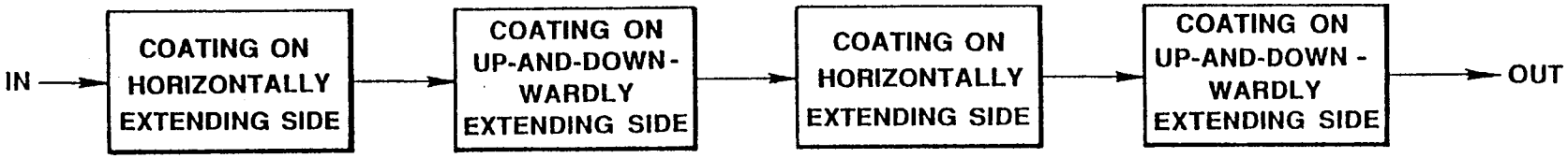
Figure 20:
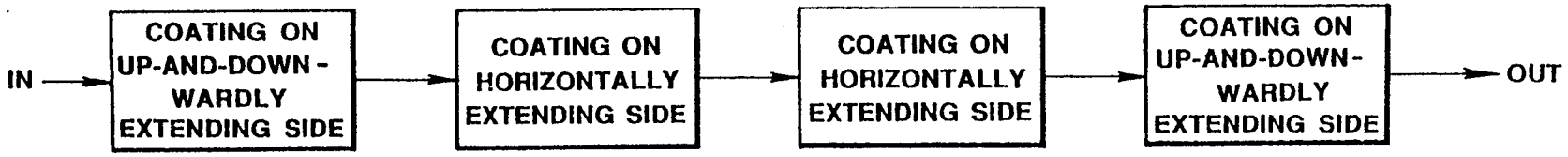

When the body W is coated with the paint in two stages, the first stage may be to spray the paint on the side of the body W extending in a substantially up-and-downward direction and the second stage is to spray it on the side extending in a substantially horizontal direction may be repeated. Specifically, as shown in FIG. 19, the first and second steps of spraying may be carried out in a first stage and then the first and second steps of spraying may be repeatedly carried out in the second stage. Furthermore, as shown in FIG. 20, the first and second steps of spraying are carried out in a first stage, and then the second step of spraying is repeated prior to the first step of spraying is carried out in a second stage.

Figure 21:
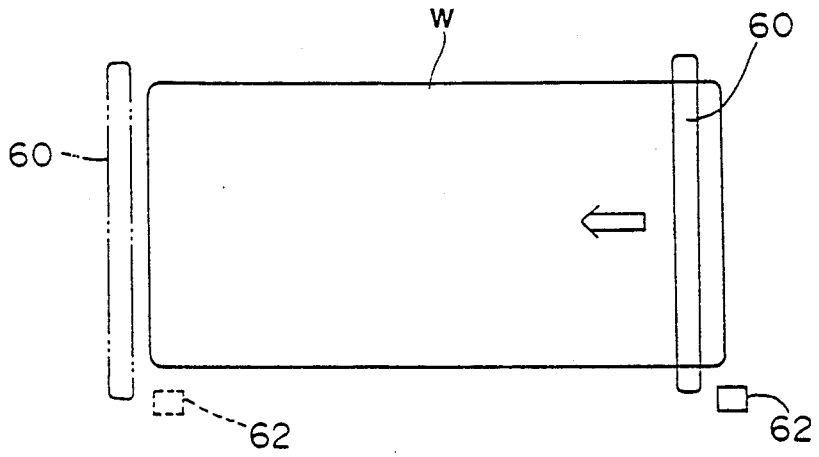
FIG. 21 is a view showing a variant in the coating step according to the present invention.

Variants in Coating Step (FIG. 21)

The coating on the vehicle body W may be carried out in a manner as shown in FIG. 21. Referring to FIG. 21, a coating system is arranged such that the body W is placed on a coating line without conveyance and a series of nozzles 60 for spraying the paint on the horizontally extending side of the body W is transferred in a longitudinal direction of the body W in synchronization with nozzles 62 for spraying the up-and-downwardly extending side thereof. The nozzles 60 are disposed on an outlet side of the direction in which a set of the nozzles are transferred and the nozzles 62 are disposed on an inlet side of the direction therein. This arrangement for the spraying nozzles permits a coating on the horizontally extending side and then a coating on the up-and-downwardly extending side. Alternatively, it is also possible to arrange the nozzles 60 for spraying the paint on the horizontally extending side of the body W in a transverse direction of the body W in which the nozzles 62 for spraying it on the up-and-downwardly extending side thereof are disposed. This arrangement of the spraying nozzles enables the paint to be sprayed simultaneously on the both sides and the top side.

EXAMPLE 1 (FIG. 22)

Figure 22:
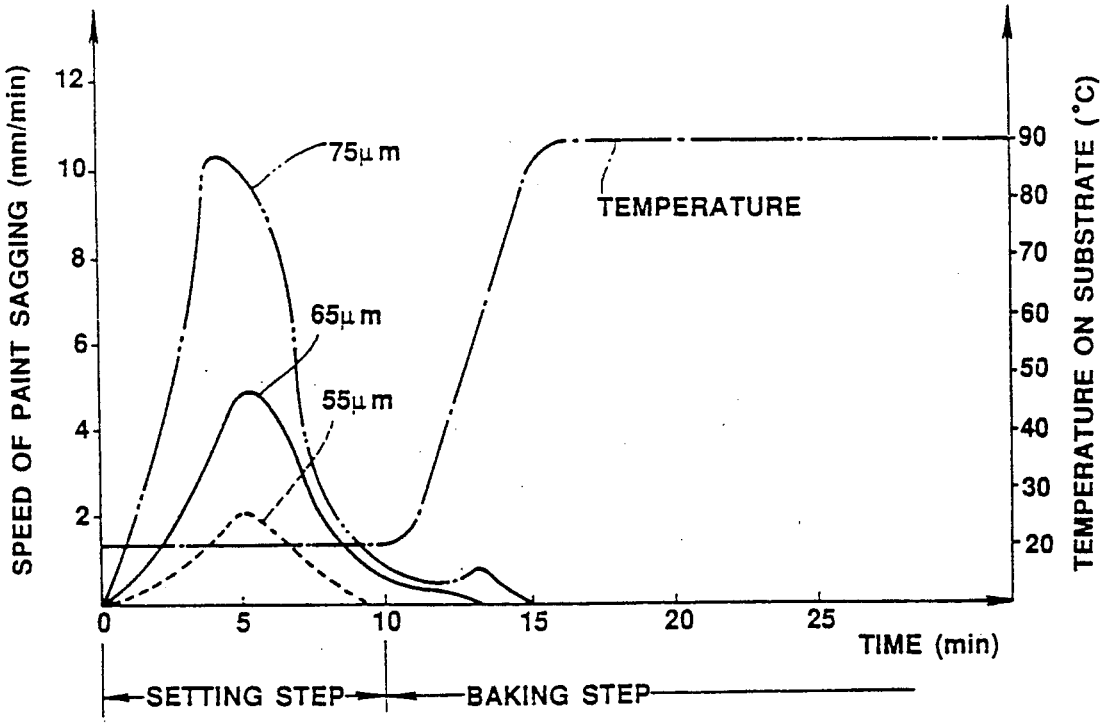
FIG. 22 is a graph showing the relationship of speeds of paint saggiing and temperatures on the coating substrate vs. the course of time during the setting and baking steps when coated in varying film thicknesses.

FIG. 22 shows examples of coatings of a two-liquid setting paint which may cause sagging in the setting step P3 only, not in the baking step P4.

The paint was coated and cured under the following conditions:

(a) Paint: polyester urethane paint (color: white) (Nippon B. Chemical K. K.; Tradename: "R-263")
Main resin: polyester polyol
Curing agent: hexamethylene diisocyate
Weight ratio: 4 (main resin) to 1 (curing agent)
(b) Coater: Air spray gun of compressive type (Tradename: Wider W71; Iwata Tosoki K. K.)
(c) Spraying viscosity: 16 seconds/Ford Cup #4
(d) Amount of paint sprayed: 350 cc per minute
(e) Air pressure for spraying: 4.0 kg/cm$^2$
(f) Spraying distance: 30 cm from spray guns
(g) Number of spraying: two times (at the interval of 3 minutes)
(h) Setting temperature and time:
20° C. and 10 minutes
(i) Baking temperature and time:
140° C. and 25 minutes (elevated from 20° C. to 140° C. in 8 minutes)

Referring to FIG. 22, the paint coated in three different film thicknesses of 55 μm, 65 μm, and 75 μm was shown to sag in the setting step and to cause no or little sagging in the baking step.

Figure 23:
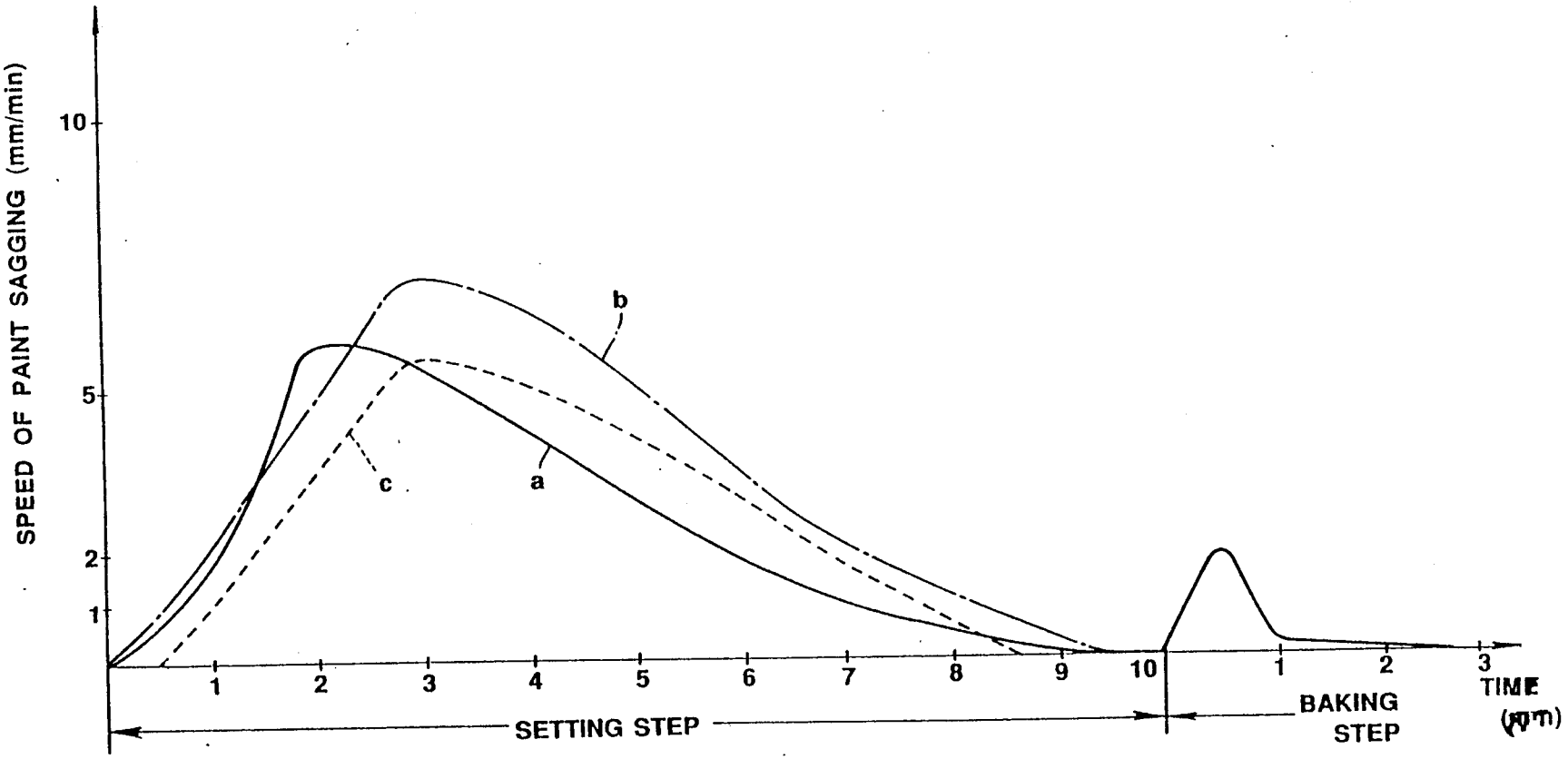
FIGS. 23 to 28 are graphs each showing the relationship of speeds of paint sagging vs. the course of time during the setting and baking steps when a different type of paints was coated in varying film thicknesses.
Figure 24:
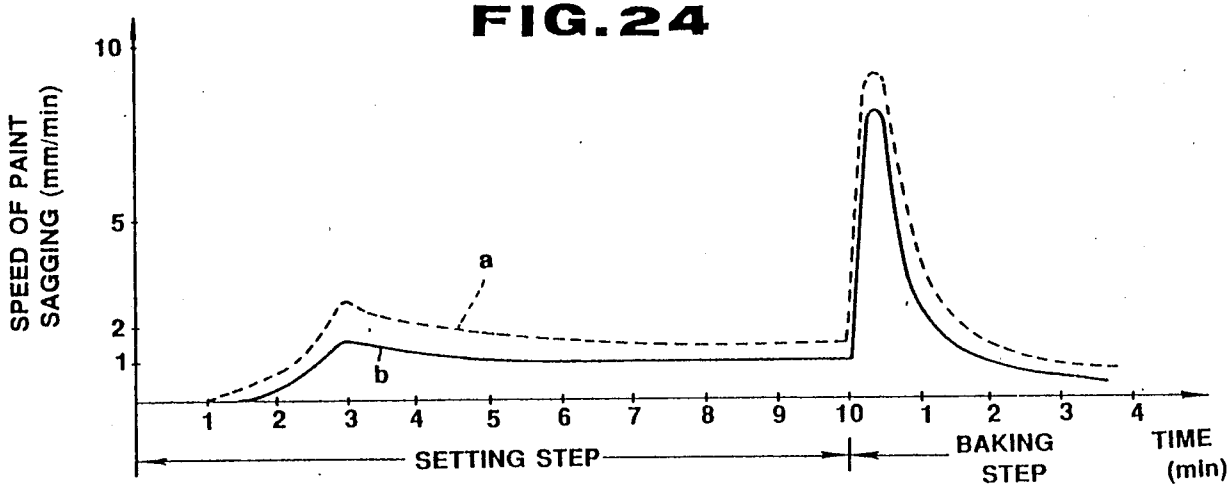
Figure 25:
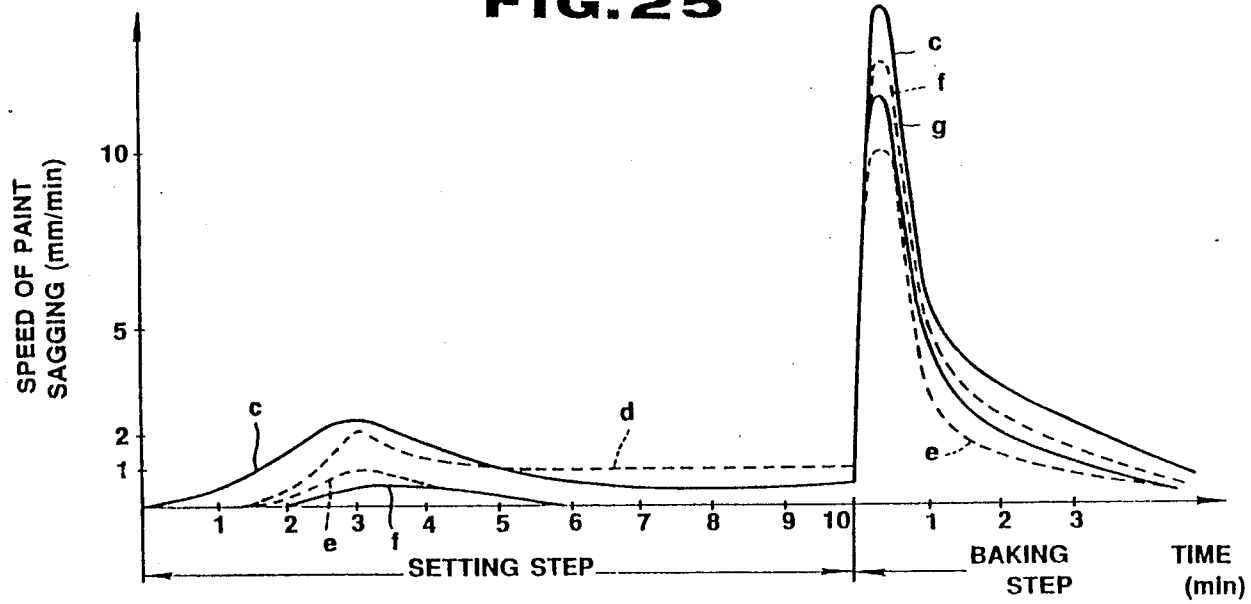
Figure 26:
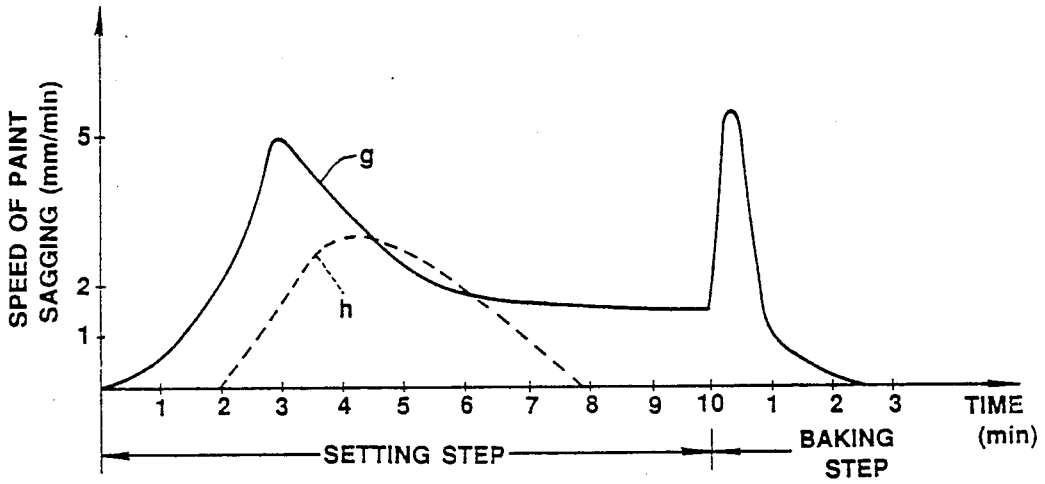
Figure 27:
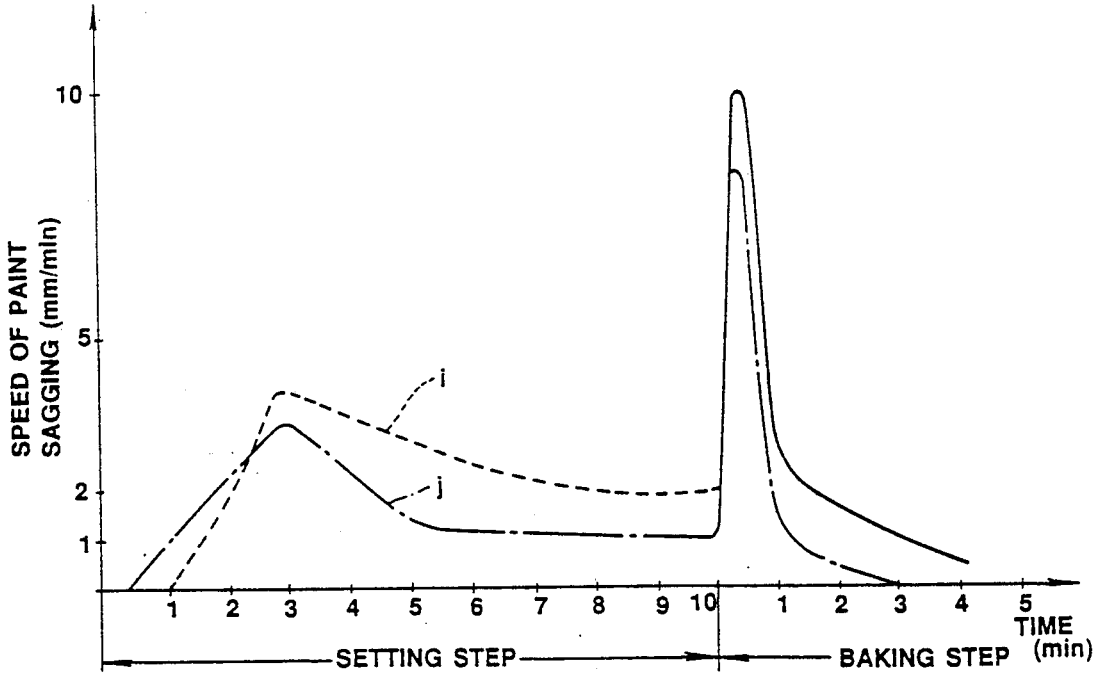
Figure 28:
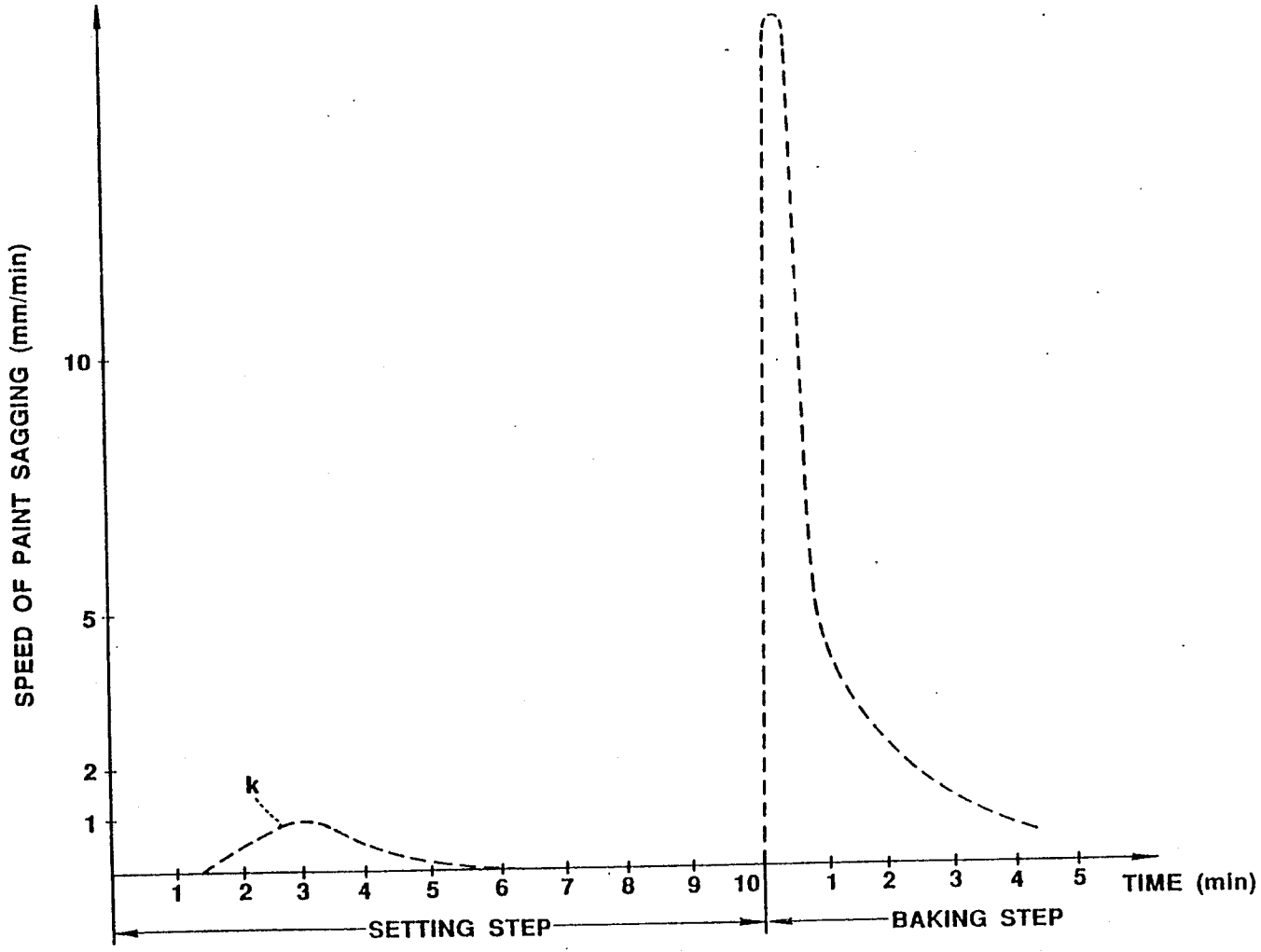

EXAMPLES 2(a)–2(c) (FIG. 23)

FIG. 23 shows examples of coatings of a thermosetting paint. This paint has the property that it sags in the setting step and does not or little sag in the baking step.

A cold rolled steel plate was subjected to zinc phosphate treatment in conventional manner and the undercoated by conventional cation electrodeposition to form an undercoating with a film thickness of 25 μm. The plate undercoated was then baked at 170° C. for 25 minutes. The intercoating was sprayed with a conventional intercoating paint and the intercoating was baked at 140° C. for 25 minutes to form a coating with a film thickness of 40 μm. The intercoating was then subjected to wet rubbing treatment with a #800 water-resistant polishing paper.

Using a thermosetting paint whose degree of viscosity was changed by adding a different quantity of a sagging preventive agent as shown in Table 1, the overcoating was carried out under the following conditions:

(a) Paint: melamine alkid paint (color: black)

(b) Solvent:
toluol: 4% by weight
Solvesso 100 (Esso): 3% by weight
Solvesso 150 (Esso): 3% by weight (c) Sagging preventive agent: cross-linked acrylic resin added in a quantity as shown in Table 1 below, a quantity being expressed in % by weight with respect to all unvolatilizables (d) Coating conditions: sprayed in two stages under conditions as indicated in Table 2 below (e) Spraying viscosity: measured by Ford Cup #4 at 20° C.
Setting temperature and time: 20° C. and 10 minutes (f) Baking temperature and time:
140° C. and 25 minutes (elevated from 20° C. to 140° C. in 8 minutes)

(g) Rotation conditions: The substrate was rotated about its horizontal axis at the speed of 10 rpm until no sagging was caused in the setting step.

Table 1 below indicates degrees of viscosity, quantities of sagging preventing agents, and PGD values on a coating surface of overcoatings measured using an image sharpness degree measurer.

TABLE 1

| | | Examples | | |
|---|---|---|---|---|
| | | 2 (a) | 2 (b) | 2 (c) |
| First Stage | Degree of Viscosity | 30 | 15 | 15 |
| | Sagging preventive agent (% by wt) | 0 | 0 | 0 |
| First Stage | Degree of Viscosity | 22 | 15 | 22 |
| | Sagging preventive agent (% by wt) | 3 | 6 | 6 |
| PGD Values | | 0.9 | 1.0 | 1.0 |

The conditions in which the coating was carried out by a coater (Minibell with a bell size of 60 cm) in two stages are as shown in Table 2 below:

TABLE 2

| | | FIRST STAGE | SECOND STAGE |
|---|---|---|---|
| Number of Rotation (rpm) | | 22,000 | 22,000 |
| Shaping air pressure (kg/cm$^2$) | | 3.0 | 3.0 |
| Voltage (KV) | | −90 | −90 |
| Distance from gun (cm) | | 30 | 30 |
| Amount of Spraying (cc/min) | Viscosity (22 seconds) | 100 | 180 |
| | Viscosity (30 seconds) | 70 | 120 |
| Dry Film Thickness (μm) | | 15–20 | 30–35 |
| Interval between sprayings | | 5 minutes | |
| Booth Temperature (°C.) | | 20 ± 2 | 20 ± 2 |
| Booth Air Velocity (m/sec) | | 0.3 ± 0.1 | 0.3 ± 0.1 |

EXAMPLES 3–7 (FIGS. 24–28)

If there is no equipment capable of rotating the vehicle body immediately next to the coating step P2, it is preferred to use a paint which does not sag in the coating step P2 and which substantially causes sagging at least in one of the sequential setting and baking steps P3 and P4, respectively. The use of such a paint does not put any restrictions upon equipment and is advantageous because it gives a sufficient time to transfer the body W from the coating step P2 to the drying step P3 and P4.

FIGS. 24 to 28 show each sagging characteristics of a thermosetting paint which does not substantially sag in the coating step P2 yet which causes sagging in the setting step P3 or in the baking step P4.

A thermosetting paint was overcoated on an intercoating of the cold rolled steel plate prepared in Example 1 above under the following conditions:

(a) Paint: melamine alkid paint (color: black)

(b) Solvent:
toluol: 4% by weight
Solvesso 100 (Esso): 3% by weight
Solvesso 150 (Esso): 3% by weight (c) Sagging preventive agent: cross-linked acrylic resin added in a quantity as shown in Table 3 below, a quantity being expressed in % by weight with respect to all unvolatilizables (d) Coating conditions: sprayed in two stages under conditions as indicated in Table 3 below (e) Spraying viscosity: measured by Ford Cup #4 at 20° C.
Setting temperature and time: 20° C. and 10 minutes (f) Baking temperature and time:
140° C. and 25 minutes (elevated from 20° C. to 140° C. in 8 minutes)

(g) Rotation conditions: The substrate was rotated about its horizontal axis at the speed of 10 rpm until no sagging was caused in the setting step.

TABLE 3

| | FIRST STAGE | | SECOND STAGE | |
|---|---|---|---|---|
| PAINT | VISCOSITY (second) | AMOUNT OF SAGGING PREVENTIVE AGENT (% by wt) | VISCOSITY (second) | AMOUNT OF SAGGING PREVENTIVE AGENT (% by wt) |
| a | 22 | 3 | 22 | 3 |
| b | 22 | 3 | 30 | 3 |
| c | 15 | 6 | 22 | 3 |
| d | 30 | 3 | 22 | 3 |
| e | 22 | 6 | 22 | 3 |
| f | 30 | 6 | 22 | 3 |
| g | 15 | 3 | 22 | 3 |
| h | 15 | 0 | 30 | 6 |
| i | 30 | 3 | 30 | 0 |
| j | 15 | 6 | 30 | 0 |
| k | 20 | 6 | 22 | 3 |

EXAMPLE 8 (FIG. 29)

Figure 29:
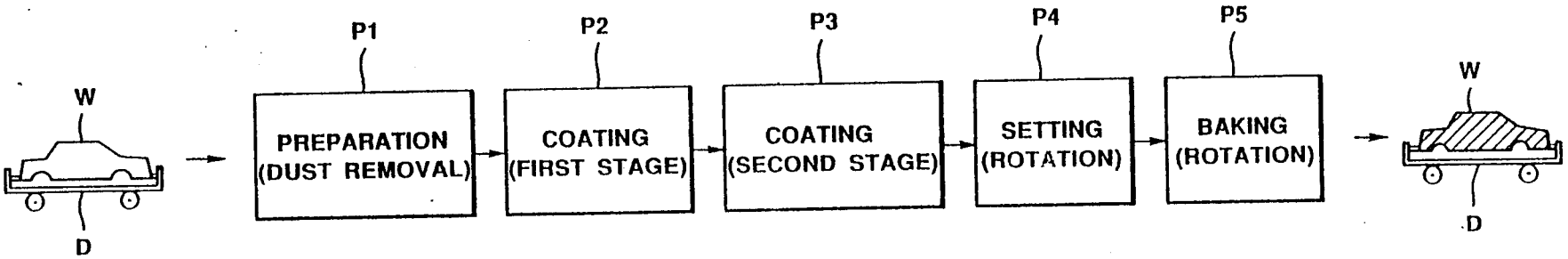
FIG. 29 is a flowchart showing another order of steps constituting the coating method according to the present invention.

FIG. 29 indicates an example of the present invention which is directed to the coating step to be carried out in two stages producing a coating on an up-and-downwardly extending side with a degree of flatness substantially the same as or similar to that on a horizontally extending side. In FIG. 29, the preparation step P1, the setting step P4, and the baking step P5 are the same as the steps P1, P3, and P4 of the description made hereinabove so that a description thereon will be omitted herein for brevity of explanation.

As shown in FIG. 29, the paint is coated in two stages in the first stage coating step P2 and in the second stage coating step P3.

The first stage coating step P2 is designed to coat with a paint a side of the vehicle body W extending in a substantially up-and-downward direction, namely, left-hand and right-hand sides as well as forward and rearward sides. A film thickness of the paint to be sprayed in the first stage coating step P2 may be, for example, 20 μm, which is thinner than a desired final film thickness, for example, as thick as 60 μm, and which is thicker than a film thickness in which the paint substantially sags, for example, as thick as 20 μm.

The second stage coating step P3 is designed to spray a paint on sides extending in a horizontal direction, such as a roof panel, a bonnet panel, a trunk lid and the like, as well as on the up-and downwardly extending sides. In this coating step P3, the paint is sprayed on the up-and-downwardly extending sides in a film thickness, for example, as thick as 40 μm, which reaches the desired final film thickness. The additional coating in the second stage causes sagging on the up-and-downwardly extending sides at least in either of the setting step P4 or the baking step P5.

On the sides extending in a horizontal direction, the paint as sprayed on the up-and downwardly extending sides is sprayed in the second stage coating step P3 only in a film thickness as thick as a desired final thickness, for example 50 μm, which is usually thinner than the desired final film thickness on the sides extending in an up-and downward direction. Although the film thickness of the coating sprayed in the second stage coating step P3 may be to an extent that the coating does not substantially sag, it is preferred to spray even on the horizontally extending side with the paint in a film thickness which causes sagging at least in either of the setting step P4 or the baking step P5 in order to provide a coating surface with a higher degree of flatness if the film thicknesses are the same. It is also possible to make the paint sag at least in either of the setting step P4 or the baking step P5 even in a film thickness which is thinner than its sagging limit thickness by increasing an amount of a solvent of by reducing an amount of a sagging preventive agent.

As have been described hereinabove, it is sufficient that the paint coated on the sides extending in and up-and-downward direction and, preferably, in a horizontal direction causes sagging at least in one of the setting step P4 and the baking step P5. It is thus possible to cause sagging in the baking step P5 only. Furthermore, the spraying of the paint on the horizontally extending side may be effected in the first stage coating step P2 alone or in both the first and second stage coating steps P2 and P3 although it is preferred to spray the horizontally extending side with the paint in the second stage coating step P3 because adverse influences of spraying in an excessive amount upon the horizontally extending side can be reduced as much as possible. If the paint is sprayed on the side extending in a horizontal direction in a final film thickness which is thicker than its sagging limit thickness, it is preferred to spray the paint in the first stage coating step P2 in a film thickness which is thinner than the sagging limit thickness and in the second stage coating step P3 in a film thickness which is thicker than the sagging limit thickness.

Rotation Jig and Carriage

Description on a rotation jig and a carriage for use for the rotation of the coating substrate such as the vehicle body W will be made hereinafter in conjunction with FIGS. 5 to 15.

Rotation Jig

The vehicle body W is mounted horizontally on the carriage through a pair of rotation jigs so as to be rotatable about its axis extending horizontally in a longitudinal direction of the body W.

Figure 5:
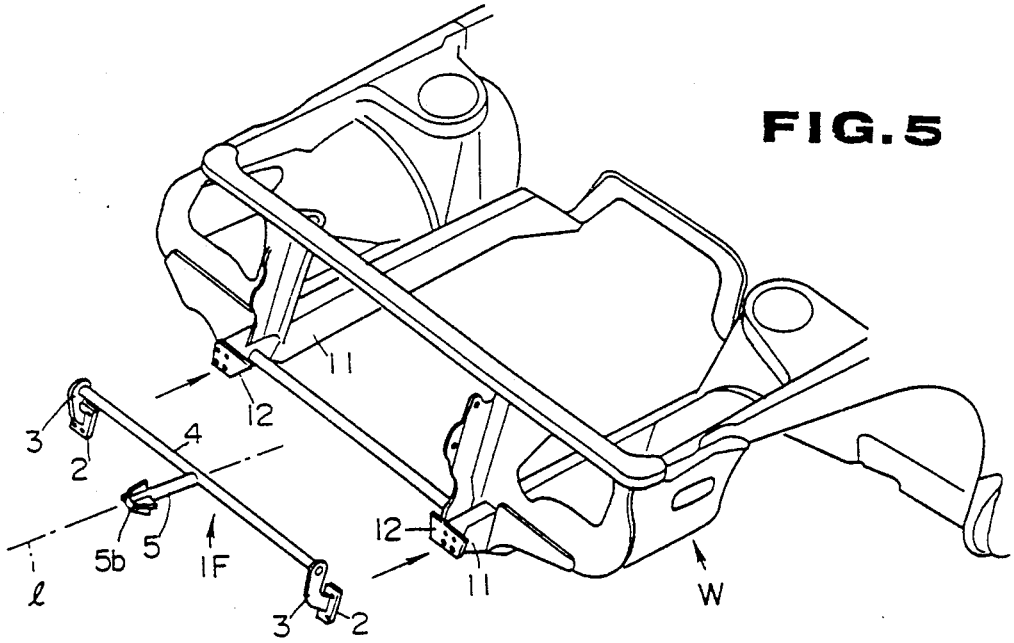
FIG. 5 is a perspective view showing a front jig for rotating the vehicle body.

FIG. 5 shows a front rotation jig 1F for horizontally supporting a forward portion of the body W. The front rotation jig 1F comprises a pair of left-hand and right-hand mounting brackets 2, a pair of left-hand and right-hand stays 3 welded to the corresponding left-hand and right-hand mounting brackets 2 and a connection bar 4 for connecting the pair of the stays 3, and a rotary shaft 5 connected integrally to the connection bar 4. The front rotation jig 1F is fixed at its portions of the brackets 2 to a forward end portion of a front reinforcing member of the vehicle body W such as a front side frame 11. To the front side frame 11 is usually welded mounting brackets 12 for mounting a bumper (not shown), and the brackets 2 are fixed with bolts (not shown) to the brackets 12 on the side of the body W.

Figure 6:
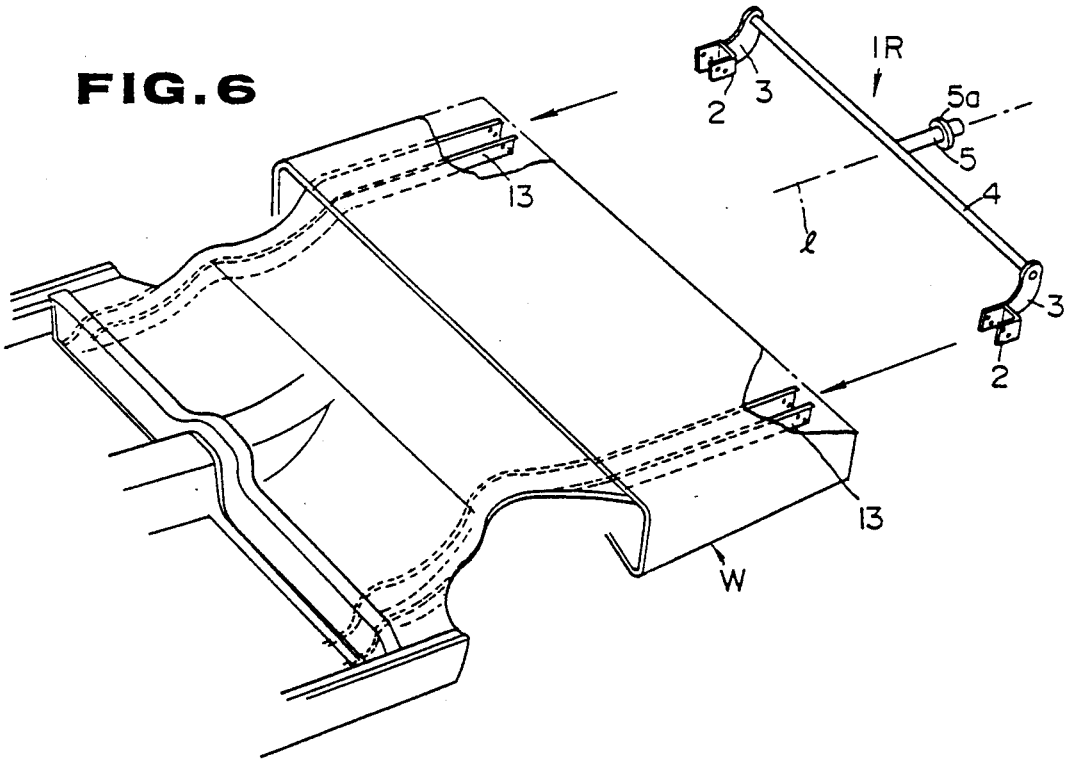
FIG. 6 is a perspective view showing a rear jig for rotating the vehicle body.

FIG. 6 shows a rear rotation jig 1R for horizontally supporting a rearward portion of the vehicle body W, which substantially the same structure as the front rotation jig 1F. In the drawing, the same elements for the rear rotation jig 1R as for the front rotation jig 1F are provided with the same reference numerals as the latter. The mounting of the rear rotation jig 1R to the vehicle body W is effected by fixing brackets 2 with bolts (not shown) to the floor frame 13 disposed at a rearward end portion of the vehicle body W as a rigidity adding member. Alternatively, the rear rotation jig 1R may be mounted to the body W through a bracket for mounting the bumper, the bracket being welded to a rearward end portion of the floor frame 13.

Figure 7:
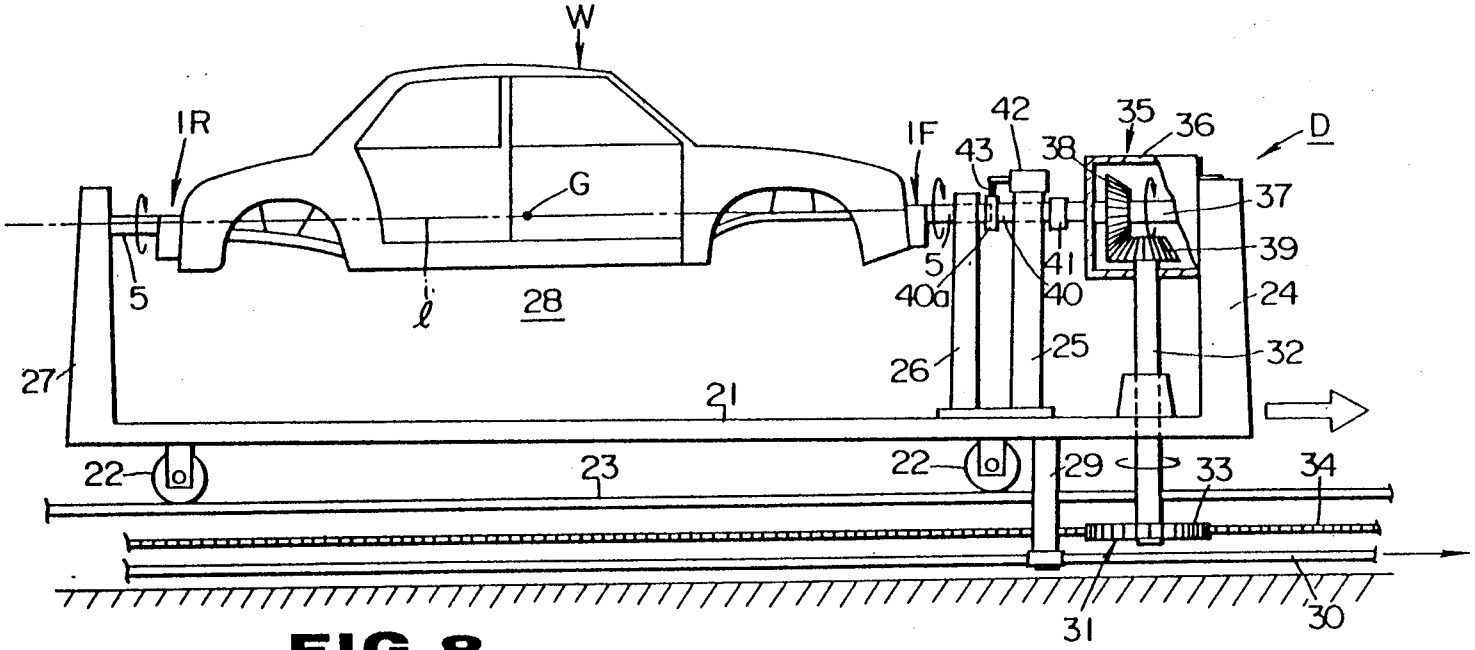
FIG. 7 is a side view showing the side portion of a vehicle-body conveying carriage for rotating the vehicle body.
Figure 9:
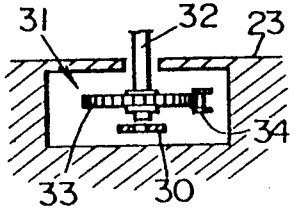
FIG. 9 is a cross-sectional view taken along line X9—X9 of FIG. 8.
Figure 8:
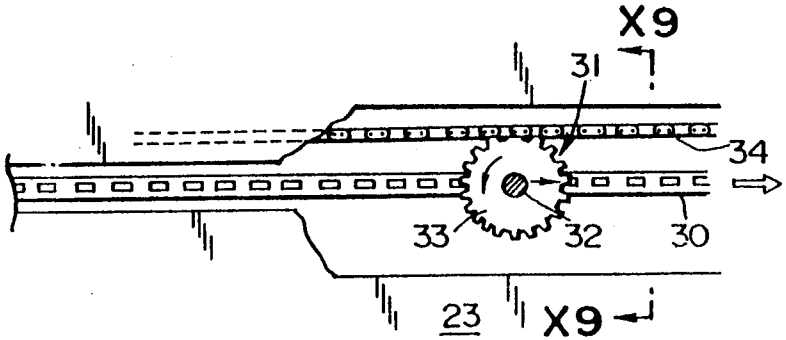
FIG. 8 is a partially cut-out plane view showing the structure of a conveying means underneath a passageway on which the carriage travels.

The front and rear rotation jigs 1F and 1R are mounted to the body W in such a manner that their respective rotary shafts 5 extend horizontally on the same straight line in its longitudinal direction when the body W is mounted on the carriage D through the front and rear rotation jigs 1F and 1R. The very straight line is the horizontal axis l about which the body W is rotated. It is preferred that the horizontal axis is designed so as to pass through the center of gravity G of the body W as shown in FIG. 7. The arrangement for the horizontal axis l to pass through the center of gravity G serves as preventing a large deviation of a speed of rotation. This can prevent an impact upon the body W accompanied with the large deviation in rotation, thus preventing the paint coated from sagging.

The front and rear rotation jigs 1F and 1R may be prepared for exclusive use with the kind of vehicle bodies.

Carriage

The carriage which will be described hereinbelow is a carriage that may be used at least during the coating step P2 and/or in the setting step P3 and that is provided with a mechanism for rotating or turning the vehicle body W about its horizontal axis l extending in a longitudinal direction thereof.

Referring to FIG. 7, the carriage D is shown to include a base 21 and wheels 22 mounted to the base 21 with the wheels 22 arranged to operatively run on rails 23. On the base 21 is mounted one front support 24, two intermediate supports 25 and 26, and one rear support 27, each standing upright from the base 21, as shown in the order from the forward side to the rearward side in a direction in which the vehicle body W is conveyed. Between the intermediate supports 25, 26 and the rear support 27 is formed a space 28 within which the body W is mounted through the front and rear rotation jigs 1F and 1R.

The vehicle body W is loaded in the space 28 and supported rotatably at its forward portion by the intermediate support 26 through the front rotation jig 1F and at its rearward portion by the rear support 27 through the rear rotation jig 1R.

Figure 10:
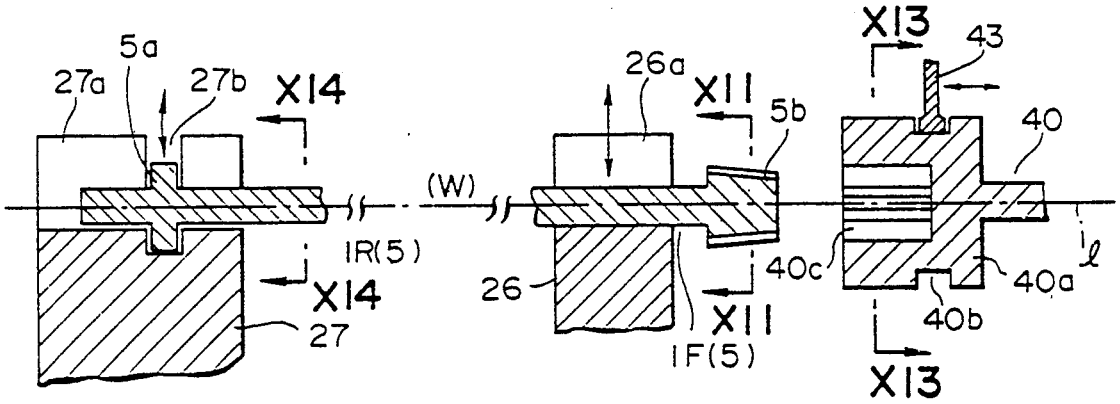
FIG. 10 is a cross-sectional side view showing a connecting portion at which the carriage is connected to a rotarty jig.
Figure 11:
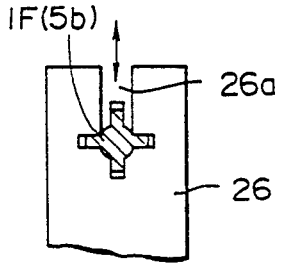
FIG. 11 is a cross-sectional view taken along line X11—X11 of FIG. 10.
Figure 13:
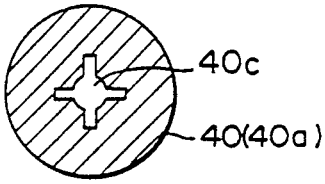
FIG. 13 is a cross-sectional view taken along line X13—X13 of FIG. 10.
Figure 12:
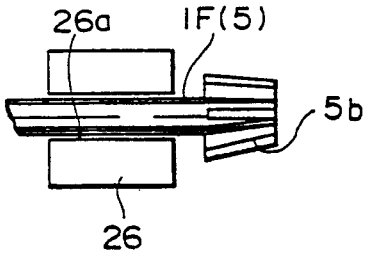
FIG. 12 is a plane view of FIG. 10.
Figure 16:
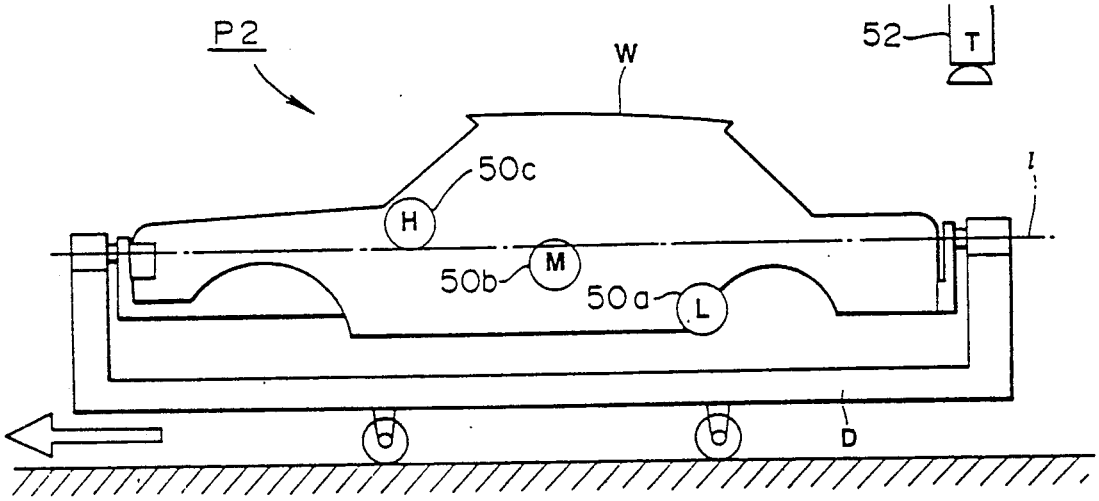
FIGS. 16 and 17 are a side view and a front view, respectively, showing positions of spray guns along a direction of conveyance of the carriage.
Figure 17:
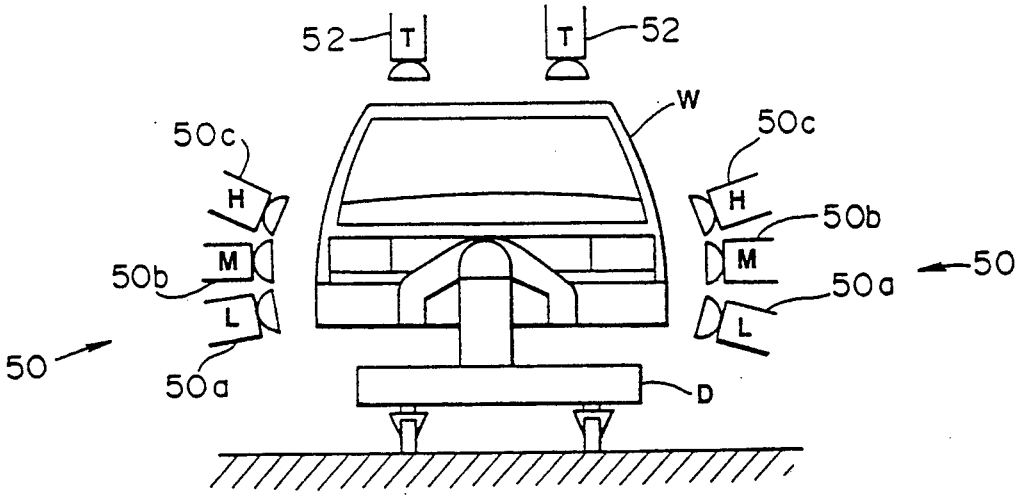

As shown in FIGS. 10, 11, and 12, on the one hand, the intermediate support 26 is provided at its top surface with a groove 26*a* which in turn is designed so as to engage or disengage the rotary shaft 5 of the front rotation jig 1F with or from the support 26 in a downward direction or in an upward direction.

Figure 14:
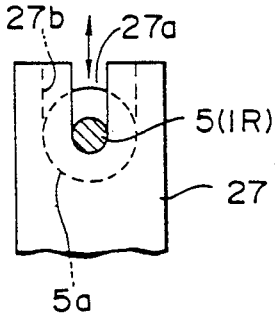
FIG. 14 is a cross-sectional view taken along line X14—X14 of FIG. 10.
Figure 15:
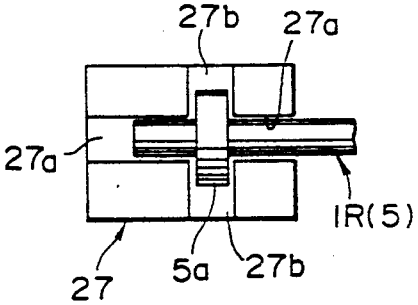
FIG. 15 is a plane view of FIG. 14.

As shown in FIGS. 10, 14, and 15, on the other hand, the rear support 27 is provided at its top surface with a groove 27*a* which engages or disengages the rotary shaft 5 of the rear rotation jig 1R with or from the rear support 27. The rear rotation jig 1R if further provided with a groove 27*b* in a shape corresponding to a flange portion 5*a* provided on the rotary shaft 5 of the rear rotation. jig 1R, the groove being communicated with the groove 27*a*.

This arrangement permits the engagement or disengagement of the rotary shaft 5 with or from the front and rear rotation jigs 1F and 1R in a downward direction or in an upward direction, but it allows the rear rotation jig 1R to be unmovable in a longitudinal direction in which the horizontal axis extends due to a stopper action of the flange portion 5*a*.

As shown in FIGS. 10, 11, and 12, the rotary shaft 5 of the front rotation jig 1F is provided at its end portion with a connection portion 5*b* through which a force of rotation of the rotary shaft 5 of the front rotation jig 1F is applied to the vehicle body W, as will be described hereinbelow.

From the base 21 extends downwardly a stay 29 to a lower end portion of which is connected a retraction wire 30. The retraction wire 30 is of endless type and is drivable in one direction by a motor (not shown). The retraction wire 30 thus drives the carriage D in a predetermined direction in which the body W should be conveyed. The motor should be disposed in a safe place from the viewpoint of security from explosion.

The rotation of the vehicle body W may be carried out using a movement of the carriage D, that is, using a displacement of the carriage D with respect to the rails 23. The displacement of the carriage D may be converted to a force of rotation using a mechanism 31 for converting the displacement of the carriage D into rotation. The mechanism 31 comprises a rotary shaft 32 supported rotatably by the base 21 and extending in a vertical direction from the base 21, a sprocket 33 fixed on the lower end portion of the rotary shaft 32, and a chain 34 engaged with the sprocket 33. The chain 34 is disposed in parallel to the retraction wire 30 in such a state that it does not move along the rails 23. As the carriage D is retracted by the retraction wire 30, the sprocket 33 allows the rotary shaft 32 to rotate because the chain 34 is unmovable.

A force of rotation of the rotary shaft 32 is transmitted to the rotary shaft 5 of the front rotation jig 1F through a transmitting mechanism 35 which comprises a casing 36 fixed on a rearward side surface of the front support 24, a rotary shaft 37 supported rotatably to the casing 36 and extending in a longitudinal direction of the body W, a pair of bevel gears 38 and 39 for rotating shaft 32, and a connection shaft 40 connected to the front support 25 rotatably and slidably in the longitudinal direction thereof. The connection shaft 40 is spline connected to the rotary shaft 37, as indicated by reference numeral 41 in FIG. 7. This construction permits a rotation of the connection shaft 32 to rotate the rotary shaft 40. It is understood that the rotary shaft 37 and the connection shaft 40 are arranged so as to be located on the horizontal axis l extending in a longitudinal direction of the body W. The connection shaft 40 is connected to or disconnected from the front rotary shaft 5 of the front rotation jig 1F. More specifically, as shown in FIGS. 10 to 12, the front rotary shaft 5 of the front rotation jig 1F is provided at its end portion with a connecting portion 5*b* in a cross shape, while the connection shaft 40 is provided at its end portion with a box member 40*a* having an engaging hollow portion 40*c* that is engageable tightly with the connection portion 5*b* of the front rotary shaft 5 as shown in FIGS. 10 and 12. By slidably moving the connection shaft 40 by a rod 43, for example, using a hydraulic cylinder 42, the connection portion 5*b* is connected to or disconnected from the box member 40*a* at its engaging hollow portion 40*c*. The connection shaft 40 is rotatably integrally with the rotary shaft 5. The rod 43 is disposed in a ring groove 40*b* formed on an outerperiphery of the box member 40*a*, as shown in FIG. 10, in order to cause no interference with the rotation of the connection shaft 40. With the above arrangement, the front and rear rotary shafts 5 of the respective front and rear rotation jigs 1F and 1R are supported by the intermediate support 26 and the rear support 27 so as to be rotatable about the horizontal and longitudinal axis yet unmovable in a longitudinal direction of the body W, when the body W is lowered with respect to the carriage D in a state that the connection shaft 40 is displaced toward the right in FIG. 7. Thereafter, the connection portion 5*b* of the rotary shaft 5 is engaged with the connection shaft 40 through the engaging hollow portion 40*c* thereof, whereby the body W is allowed to rotate about the predetermined horizontal axis l by retracting the carriage D by means of the retraction wire 30. The vehicle body W can be unloaded from the carriage D in the order reverse to that described above.

It is to be understood that the foregoing text and drawings relate to embodiments of the present invention given by way of examples but not limitation. Various other embodiments and variants are possible within the spirit and scope of the present invention. In particular, the present invention is not limited to the vehicle body W for an automobile and is applicable to a variety of coating substrates.

What is claimed is:

1. A coating method comprising:

a coating step for coating a substrate by spraying with a paint, in which the substrate has a first side extending in a substantially upward-and-downward direction and a second side extending in a substantially horizontal direction; and a drying step for drying the paint sprayed on the substrate;

wherein the coating step is carried out in a manner such that the paint is coated on the second side of the substrate in a given film thickness and is coated on the first side of the substrate in a film thickness which is thicker than a film thickness at which the paint sags on the first side of the substrate and such that the coating of the first side of the substrate is carried out at the same time as or subsequent to the coating of the second side;

wherein the drying step is carried in a manner such that the substrate is rotated about its horizontal axis extending in a substantially horizontal and longitudinal direction of the substrate at least during a period of time from the time before the paint starts sagging to the time at which the paint is cured to such an extent as not to sag; and wherein the rotation of the substrate is carried out at a speed which is high enough to rotate the substrate before the paint coated thereon substantially sags due to gravity yet which is low enough to cause no sagging as a result of centrifugal force.

2. A coating method as claimed in claim 1, wherein:

the coating step is carried out in a manner such that the substrate is first coated with the paint on its second side in the given film thickness and then is coated on the first side in the film thickness which is thicker than the film thickness at which the paint sags.

3. A coating method as claimed in claim 1, wherein:

the coating step is carried out in a manner such that the substrate is first coated with the paint on its second side in a film thickness which is thicker than the film thickness at which the paint sags.

4. A coating method as claimed in claim 1, wherein:

the rotation of the substrate is carried out continuously in one given direction.

5. A coating method as claimed in claim 1, wherein:

the rotation of the substrate is alternately carried out in one direction and reversed in the opposite direction.

6. A coating method as claimed in claim 1, wherein:

the rotation of the substrate is intermittently carried out by reversing the rotation thereof in an opposite direction.

7. A coating method as claimed in claim 1, wherein:

the drying step is carried out in a manner such that the substrate is rotated until the paint does not substantially sag.

8. A coating method as claimed in claim 1, wherein:

the coating step is carried out in a manner such that the paint is sprayed in one stage and the coating on the first and second sides is finished in one stage.

9. A coating method as claimed in claim 8, wherein:

the substrate is coated on its second side with the paint in a film thickness which is thicker than the film thickness at which the paint sags.

10. A coating method as claimed in claim 1, wherein:

the coating step is carried out in a manner such that the paint is sprayed in two stages comprising first and second stages;

in which the paint is coated on the first side thereof in the first and second stages; and it is coated on the second side thereof at least in either of the first stage or the second stage.

11. A coating method as claimed in claim 10, wherein:

the paint is coated on the second side thereof only in either of the first stage or the second stage in a final film thickness which is thinner than a final film thickness in which the paint is coated on the first side thereof.

12. A coating method as claimed in claim 10, wherein:

the paint is coated on the second side thereof in both the first and second stages.

13. A coating method as claimed in claim 10, wherein:

the paint is coated on the second side of the substrate in a final film thickness which is thinner than the film thickness at which the paint sags.

14. A coating method as claimed in claim 1, wherein:

the paint is a paint which does not sag in the coating step and which substantially sags in the drying step; and the drying step is carried out in a manner such that the substrate is rotated about its substantially horizontal axis until the paint does not sag.

15. A coating method as claimed in claim 14, wherein:

the drying step comprises a setting step and a baking step; and the setting step is carried out at an ambient temperature which is lower than the ambient temperature during the baking step and in a manner that a low boiling solvent in the paint is volatilized.

16. A coating method as claimed in claim 15, wherein:

the rotation of the substrate is carried out in both the setting step and the baking step.

17. A coating method as claimed in claim 16, wherein:

the paint is a thermosetting paint.

18. A coating method as claimed in claim 1, wherein:

the substrate is a vehicle body.

19. A coating method as claimed in claim 18, wherein:

the horizontal axis is an axis of the vehicle body extending in its substantially longitudinal direction.

20. A coating method as claimed in claim 1, wherein:

the horizontal axis passes substantially through the center of gravity of the substrate.

21. A coating method as claimed in claim 10, wherein:

the paint is coated on the first side thereof in the first stage and on the second side thereof in the second stage, each in a film thickness which is thicker than the film thickness at which the paint sags.

* * * * *